US005117847A

United States Patent [19]

May

[11] Patent Number: 5,117,847

[45] Date of Patent: Jun. 2, 1992

[54] MANICURE APPARATUS

[76] Inventor: David J. May, 67330 Quijo Rd., Cathedral City, Calif. 92234

[21] Appl. No.: 740,722

[22] Filed: Aug. 6, 1991

[51] Int. Cl.[5] ..... A45D 29/18

[52] U.S. Cl. ..... 132/75.5; 132/75.4; 132/75.6; 132/73.5; 132/74.5

[58] Field of Search ..... 132/74.5, 73.5, 75, 132/75.5, 75.3, 75.6, 75.4, 73.6, 75.8; 30/26-29

[56] References Cited

U.S. PATENT DOCUMENTS 2,540,782 2/1951 Hansen ..... 30/27
3,903,596 9/1975 Crosby ..... 30/29
4,956,915 9/1990 Anderson ..... 132/73.5 X

FOREIGN PATENT DOCUMENTS 3237597 4/1984 Fed. Rep. of Germany ..... 132/75.4

*Primary Examiner*—John J. Wilson
*Assistant Examiner*—Jeffrey A. Smith
*Attorney, Agent, or Firm*—Leon Gilden

[57] ABSTRACT

A unitary transparent housing includes a clipper assembly mounted interiorly thereof aligned with a front wall opening of the housing. A cam and associated cam actuator leg is operative through a projecting actuator rod, whereupon projection of the rod interiorly of the housing effects cooperation of a fixed and movable cutter blade. An underlying tray is reciprocably and removably mounted relative to the housing to accumulate and permit ease of disposal of fingernail clippings. A modification of the invention includes a basin tray mounting as brush and abrasive sheet to enhance ease of manicuring, and further the basin tray may be provided with a fluid supply to permit directing fluid onto an individual's fingernail to assist in cleaning of the fingernail during a manicure procedure.

6 Claims, 4 Drawing Sheets

FIG 6
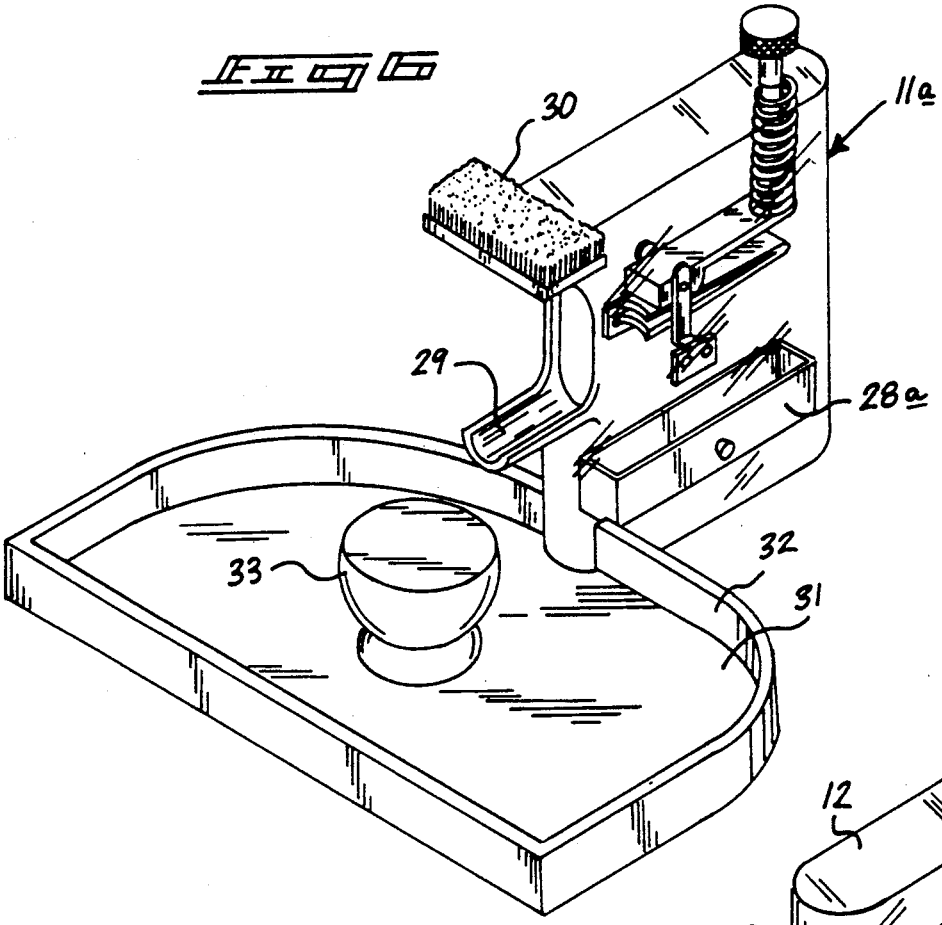
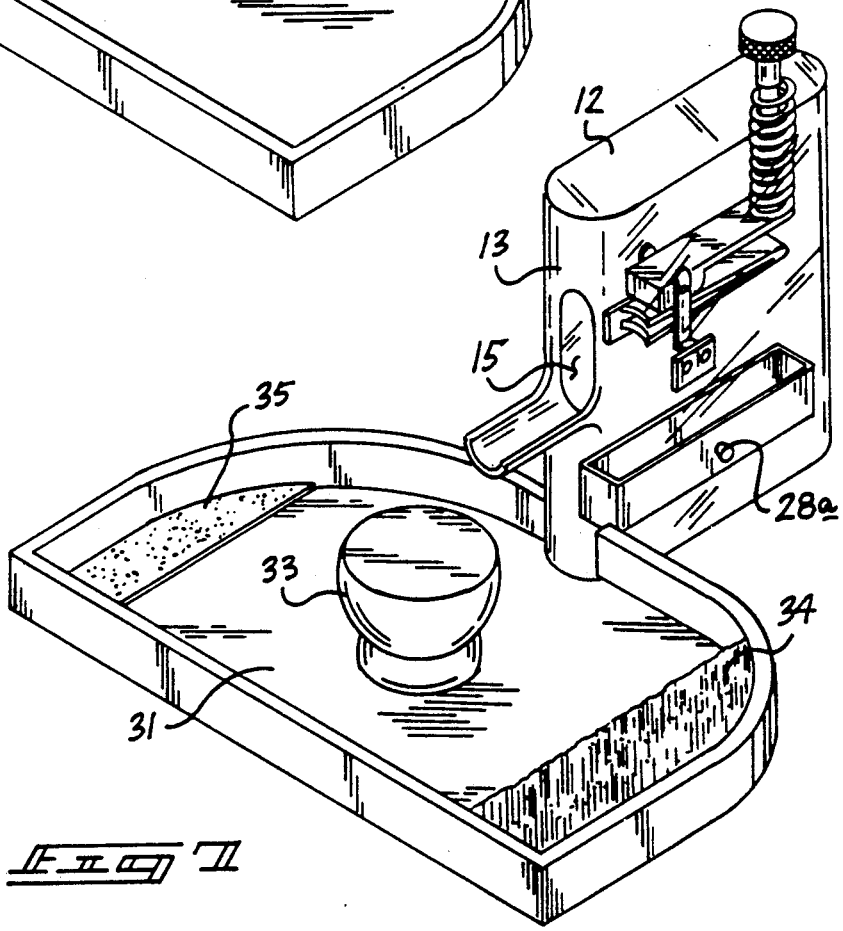
FIG 7

26
25
12
40
14
11a
34
35
29
15
28a
39
43
13
33
42
38
37
36
31
41

MANICURE APPARATUS

BACKGROUND OF THE INVENTION

1. Field of the Invention

The field of invention relates to manicure apparatus, and more particularly pertains to a new and improved manicure apparatus providing operative association of various components to effect a completed cleaning and finishing of a fingernail in a manicuring procedure.

2. Description of the Prior Art

Typically, cutting of fingernails in a manicure procedure effects a dispersal of the clippings in a random and haphazard manner. The invention helps to overcome deficiencies of the prior art by providing a unitary housing to contain such clippings for ease of disposal.

Accordingly, it may be appreciated that there continues to be a need for a new and improved manicure apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of manicure apparatus now present in the prior art, the present invention provides a manicure apparatus wherein the same provides for a unitary housing in operative association with manicuring components to effect a cutting and cleansing of a fingernail in a manicuring procedure. As such, the general purpose of the present invention, which will be described subsequently in greater detail, is to provide a new and improved manicure apparatus which has all the advantages of the prior art manicure apparatus and none of the disadvantages.

To attain this, the present invention provides a unitary transparent housing including a clipper assembly mounted interiorly thereof aligned with a front wall opening of the housing. A cam and associated cam actuator leg is operative through a projecting actuator rod, whereupon projection of the rod interiorly of the housing effects cooperation of a fixed and movable cutter blade. An underlying tray is reciprocatably and removably mounted relative to the housing to accumulate and permit ease of disposal of fingernal clippings. A modification of the invention includes a basin tray mounting a brush and abrasive sheet to enhance ease of manicuring, and further the basin tray may be provided with a fluid supply to permit directing fluid onto an individual's fingernail to assist in cleaning of the fingernail during a manicure procedure.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved manicure apparatus which has all the advantages of the prior art manicure apparatus and none of the disadvantages.

It is another object of the present invention to provide a new and improved manicure apparatus which may be easily and efficiently manufactured and marketed.

It is a further object of the present invention to provide a new and improved manicure apparatus which is of a durable and reliable construction.

An even further object of the present invention is to provide a new and improved manicure apparatus which is susceptible of a low cost of manufacture with regard to both materials and labor, and which accordingly is then susceptible of low prices of sale to the consuming public, thereby making such manicure apparatus economically available to the buying public.

Still yet another object of the present invention is to provide a new and improved manicure apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 6 is an isometric illustration of the invention utilizing a basin tray.

FIG. 7 is an isometric illustration of the instant invention utilizing the basin tray in association with a brush and abrasive sheet.

DESCRIPTION OF THE PREFERRED EMBODIMENT

Figure 1:
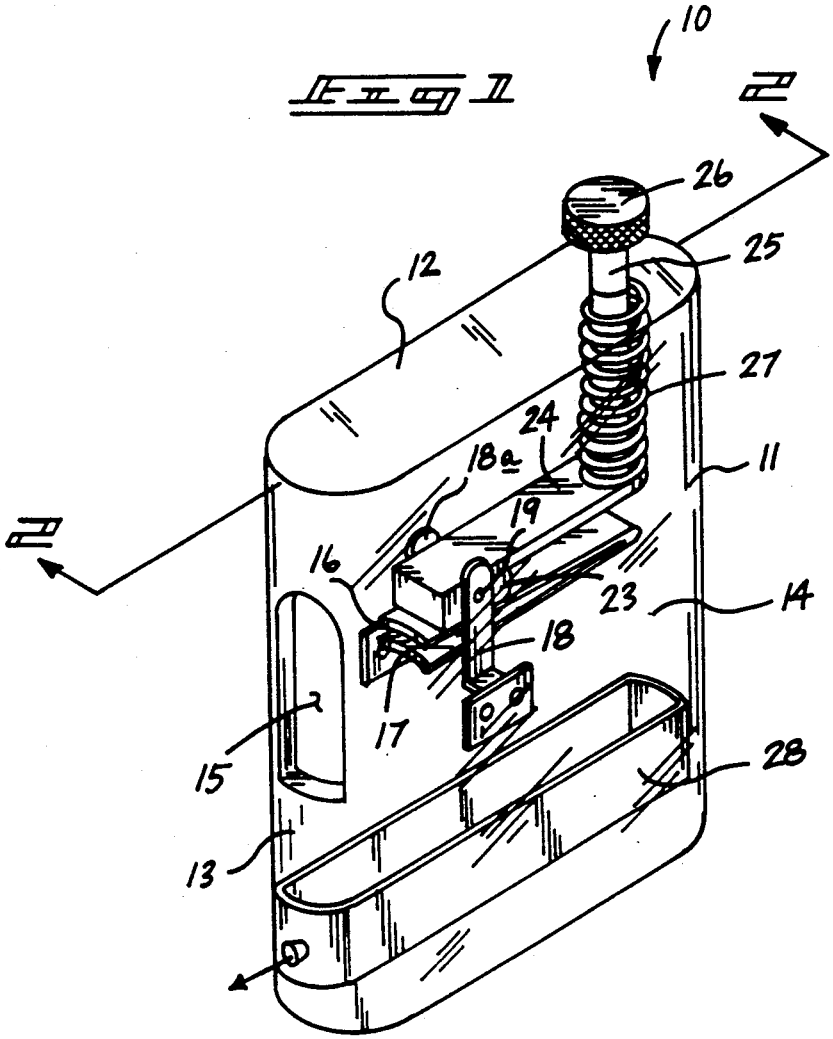
FIG. 1 is an isometric illustration of the instant invention.
Figure 2:
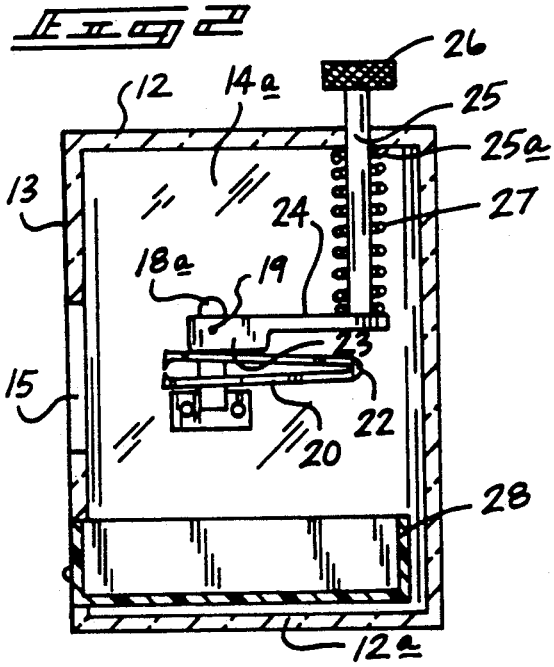
FIG. 2 is an orthographic view, taken along the lines 2—2 of FIG. 1 in the direction indicated by the arrows.
Figure 3:
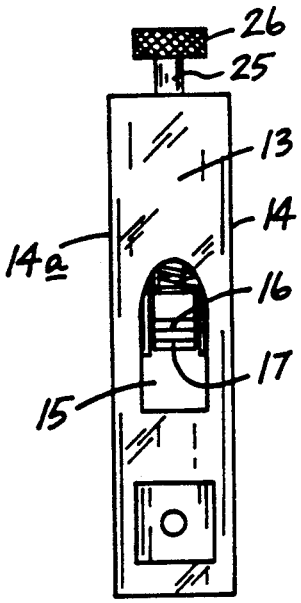
FIG. 3 is an orthographic front view, taken in elevation, of the invention.
Figure 4:
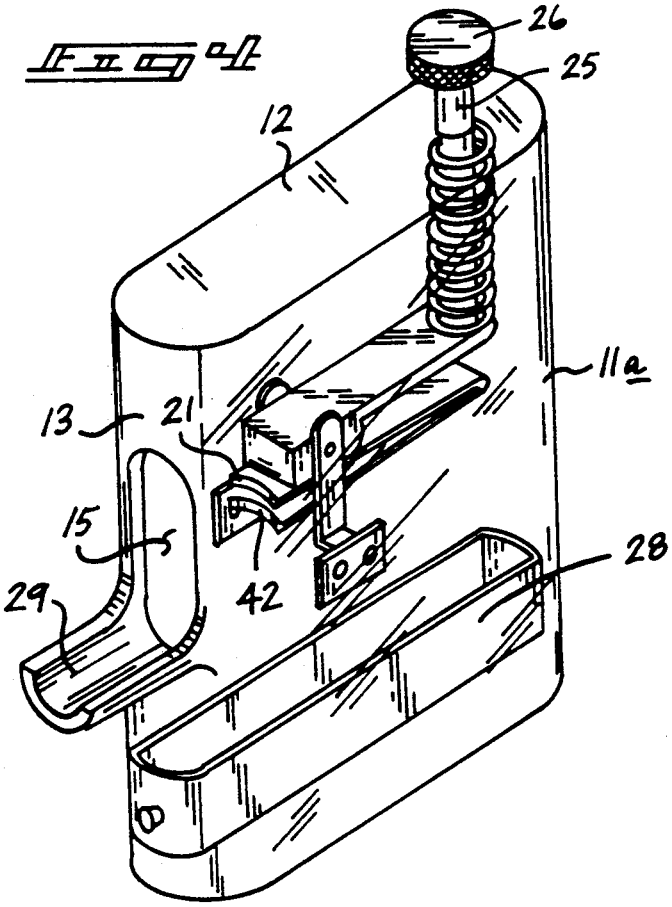
FIG. 4 is an isometric illustration of the invention utilizing a finger support tray.

With reference now to the drawings, and in particular to FIGS. 1 to 8 thereof, a new and improved manicure apparatus embodying the principles and concepts of the present invention and generally designated by the reference numeral 10 will be described.

More specifically, the manicure apparatus 10 of the instant invention essentially comprises a transparent housing 11, including a top wall 12 and a bottom wall 12*a*, a front wall 13 and spaced parallel side walls, including a right side wall 14, and a left side wall 14*a*. A front wall opening 15 is directed through the front wall 13 in alignment with a cutter assembly mounted between the side walls 14 and 14*a*. The cutter assembly includes removable upper arcuate cutter blades 16 cooperative with a fixed lower arcuate cutter blade 17. The upper and lower cutter blades are fixedly mounted to respective upper and lower cutter flanges 21 and 20 respectively. The upper and lower cutter flanges are joined together at a spring junction 22 to normally bias the upper and lower cutter flanges 21 and 20 in a separated orientation relative to one another. A right mounting plate 18 is fixedly mounted to the right side wall 14, with a left mounting plate 18*a* mounted to the left side wall 14*a*. The mounting plates are in a parallel and coextensive relationship relative to one another and fixedly and orthogonally mount the lower cutter flange 20 therebetween. A pivot axle 19 is positioned above the upper cutter flange 21 and orthogonally directed through the right and left mounting plates 18 and 18*a*, with a cam member 23 pivotally mounted about the pivot axle, with the cam member including an actuator leg 24 extending rearwardly of the cam member and cooperative with an actuator rod 25 projecting orthogonally through the top wall 12, wherein the lower terminal end of the actuator rod 25 is in contiguous communication with a top surface of the actuator leg 24 spaced rearwardly of the cam member 23. The actuator rod 25 includes a head member 26 mounted to an upper terminal end of the actuator rod above the top wall 12, with a spring 27 impinging upon a rod plate 25*a* to normally bias the head member 26 exteriorly of the top wall 12. A tray 28 is slidably mounted exteriorly of the housing 11 and positioned below the cutter assembly and the front wall opening 15. Clippings of fingernails are collected within the tray 28 whose width is substantially equal to a predetermined spacing defined between the side walls 14 and 14*a* to accumulate the clippings for the subsequent removal and disposal relative to the housing 11.

Figure 5:
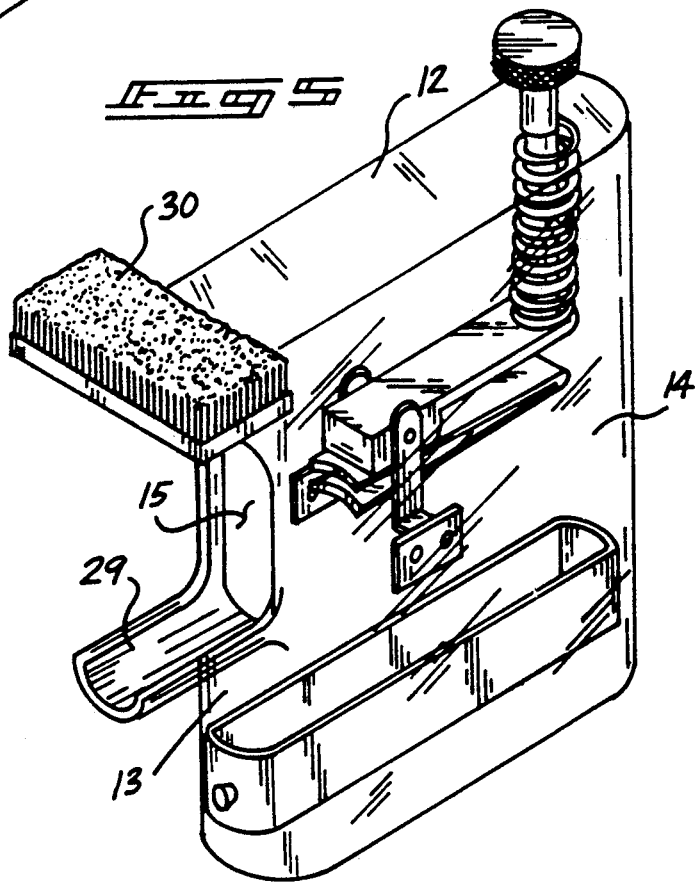
FIG. 5 is an isometric illustration of the invention utilizing a cleansing brush.

Figure illustrates the use of a modified housing 11*a*, including an arcuate concave finger support tray 29 fixedly mounted to a lower terminal end of the opening 15 at a lower terminal end thereof, wherein the concave surface projects upwardly relative to the wall 12. The housing 11, as illustrated in FIG. 5, includes a cleaning brush 30 mounted to the top wall 12 adjacent the opening 15 to permit cleaning of an individual's fingernails during a cutting procedure.

Figure 8B:
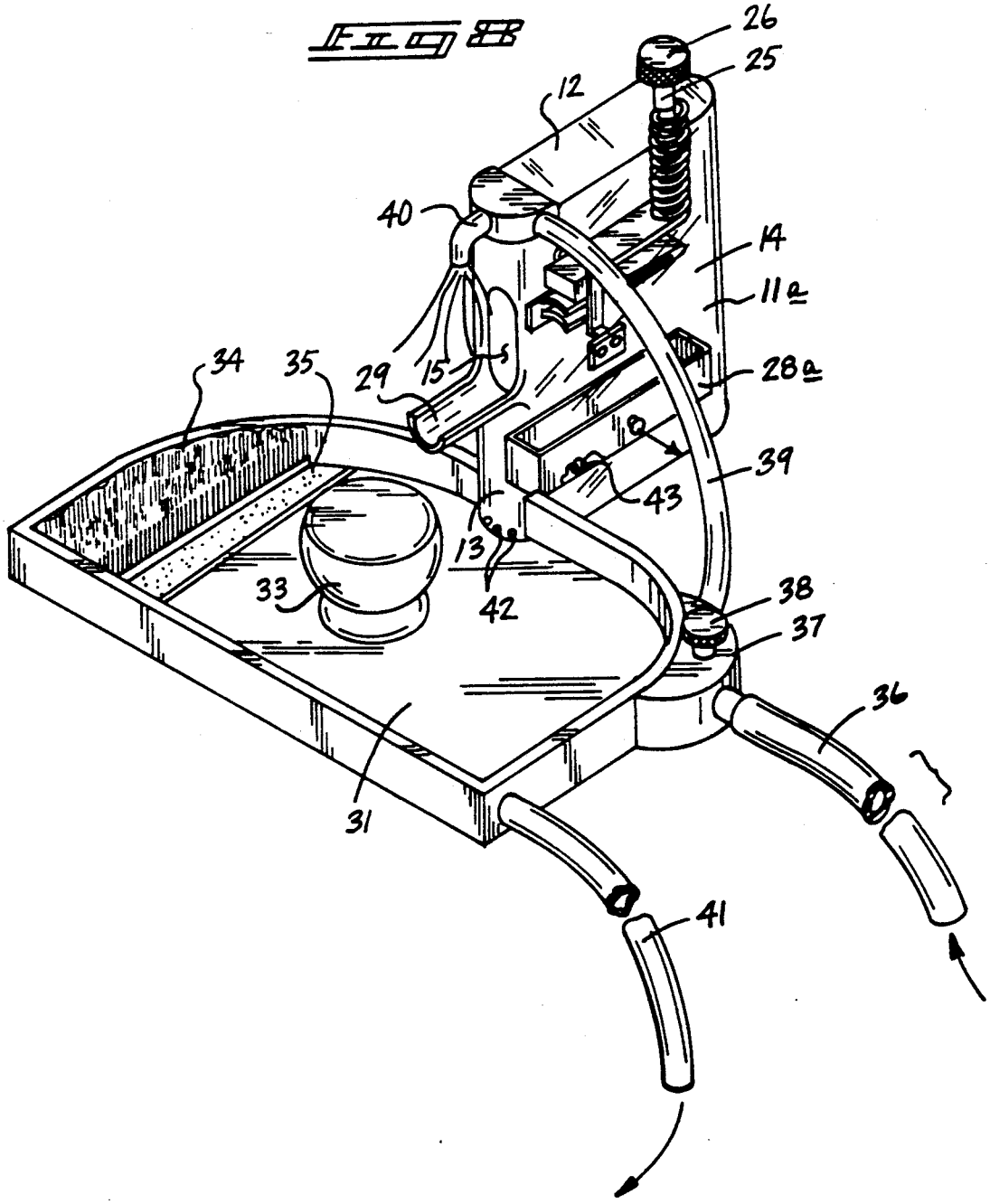
FIG. 8 is an isometric illustration of a further modified aspect of the invention, including the basin tray in association with a water supply operative to effect cleansing of a fingernail positioned upon the support tray mounted to the front wall of the housing.

FIGS. 6–8 illustrate the use of a basin tray 31 mounted to the lower terminal end of the front wall 13, with a floor of the basin in coextensive coplanar alignment with the bottom wall 12*a*. A perimeter wall 32 extends upwardly of the basin tray floor, with a palm support boss 33 positioned adjacent to and below the forward terminal end of the support tray 29 to permit positioning of an individual's palm thereon for alignment of the finger within the tray 29. The basin tray, as illustrated in FIG. 7, includes an abrasive sheet 35 cooperative with a basin tray brush 34 to provide convenience of a cleaning and finishing procedure relative to a manicuring of a fingernail. The FIG. 8 illustrates the tray 31 including the abrasive sheet 35 and the brush 34 positioned adjacent one another, and further including a first inlet hose 36 in fluid communication with the junction block 37 directing a source of water into the junction block 37, wherein a junction block valve 38 permits directing of the water into a second inlet hose 39 to a nozzle 40 positioned above the arcuate support tray 29. Water thusly accumulated within the tray 31 is directed exteriorly thereof through an outlet hose 41. Front wall openings 42 positioned at a lower terminal end of the front wall 13 permit drainage of fluid directed into the housing 11*a*, wherein the modified tray 28*a* includes tray openings 43 in the floor of the modified tray 28*a* permitting drainage of fluid therefrom. The modified tray 28*a* is slidable through the right side wall 14 for removal of the fingernail clippings contained therewithin.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent,and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A manicure apparatus, comprising, a transparent housing, including a top wall, a bottom wall, a front wall, and a right side wall spaced from and parallel a left side wall, and a front wall opening directed through the front wall between a front wall upper terminal end and a front wall lower terminal end, and a cutter assembly mounted within the transparent housing between the right side wall and the left side wall in alignment with the front wall opening, and the cutter assembly includes a right mounting plate fixedly mounted to the right side wall, a left mounting plate mounted to the left side wall, and the cutter assembly further including a lower cutter flange fixedly mounted orthogonally between the right mounting plate and the left mounting plate, and an upper cutter flange mounted to the lower cutter flange and spring biased in a spaced relationship away from the lower cutter flange, and the upper cutter flange including a movable upper arcuate cutter blade, and the lower cutter flange including a fixed lower arcuate cutter blade cooperative relative to one another, and a pivot axle orthogonally mounted between the right mounting flange and the left mounting flange above the upper cutter flange, and the pivot axle including a cam member pivotally mounted about the pivot axle in contiguous communication with the upper cutter flange, and the cam member including an actuator leg projecting rearwardly of the cam member above the upper cutter flange, and an actuator rod projecting through the top wall, wherein the actuator rod includes an actuator rod lower terminal end in contiguous communication with the actuator leg, the actuator rod including an actuator rod upper terminal end, wherein the actuator rod upper terminal end includes a head member, and the actuator rod biased in a raised orientation relative to the cam member actuator leg, wherein projection of the cam member actuator leg interiorly of the housing effects rotation of the cam member and actuation of the movable cutter blade towards the fixed lower cutter blade.

2. A manicure apparatus as set forth in claim 1 including a tray slidably mounted within the housing below the cutter assembly, the tray defined by a tray width substantially equal to a predetermined spacing between the right side wall and the left side wall, and the tray slidably removed from the housing through the right side wall.

3. An apparatus as set forth in claim 2 wherein the housing includes a basin tray, the basin tray including a basin tray floor coplanar with the housing bottom wall, the basin tray floor including a tray perimeter wall extending upwardly of the basin tray floor in surrounding relationship thereto, and a palm support boss projecting upwardly of the basin tray floor, and an arcuate concave finger support tray fixedly mounted to a lower terminal end of the front wall opening extending forwardly of the front wall opening between the front wall and the palm support boss positioned above the palm support boss.

4. An apparatus as set forth in claim 3 wherein the basin tray includes a basin tray brush member and a basin tray abrasive sheet adjacent the basin tray brush member mounted to the basin tray floor.

5. An apparatus as set forth in claim 4 including a first inlet hose mounted to a junction block, the junction block mounted to the basin tray, the junction block including a junction block valve and a second inlet hose directed from the junction block to a second inlet hose, the valve operative to effect selective fluid from the first inlet hose to the second inlet hose, and a nozzle mounted to the housing above the arcuate support tray, and the second inlet hose in fluid communication between the junction block and the nozzle, and an outlet hose in fluid communication with the basin tray through the perimeter wall to effect drainage of fluid from within the basin tray through the outlet hose.

6. An apparatus as set forth in claim 5 wherein the front wall includes a plurality of front wall openings directed through the front wall lower terminal end, and the tray includes a plurality of tray openings directed through a tray floor to effect fluid flow through the tray to the front wall openings, and the front wall openings positioned within the basin tray perimeter wall.

* * * * *